US006363635B1

(12) United States Patent
England

(10) Patent No.: US 6,363,635 B1
(45) Date of Patent: Apr. 2, 2002

(54) MEMORIAL MARKERS AND METHOD FOR PRODUCING THE SAME

(75) Inventor: Monte England, Tulsa, OK (US)

(73) Assignee: Superior Bronze Corporation of America, Tulsa, OK (US)

( * ) Notice: Subject to any disclaimer, the term of this patent is extended or adjusted under 35 U.S.C. 154(b) by 0 days.

(21) Appl. No.: 09/425,127

(22) Filed: Oct. 22, 1999

(51) Int. Cl.[7] ..... E09H 13/00
(52) U.S. Cl. ..... 40/124.5; 52/103
(58) Field of Search ..... 40/124.5, 103; 52/103

(56) References Cited

U.S. PATENT DOCUMENTS 3,962,976 A * 6/1976 Kelsey ..... 109/82
4,463,527 A 8/1984 Schlosser
4,550,537 A 11/1985 Smith
4,579,768 A 4/1986 Post
5,221,396 A 6/1993 Kane
5,595,029 A 1/1997 Revoir et al.
5,622,068 A 4/1997 Sjoberg
5,687,515 A 11/1997 Rodrigues et al.
5,729,921 A 3/1998 Rojas
5,732,515 A 3/1998 Rodrigues et al.
5,966,981 A 10/1999 Janos et al.
6,088,973 A * 7/2000 Weiss ..... 40/124.5

* cited by examiner

*Primary Examiner*—Cassandra H. Davis
(74) *Attorney, Agent, or Firm*—Head, Johnson & Kachigian

(57) ABSTRACT

A low cost, repairable memorial marker for marking a gravesite. The marker is created from a top sheet of bronze and a mating bottom sheet of bronze that are formed individually via a sheet metal forming process into the desired shape for the marker and then filled with castable filler material and welded together. Selected internal elements, such as storage compartments and bolt receiving slugs, are molded into the top and bottom sheets when they are formed, and selected external elements, such as nameplates and decorative elements, are created and secured to the top sheet after the top and bottom sheets are secured together. The marker is mounted on a base and the entire unit is installed at the gravesite.

17 Claims, 6 Drawing Sheets

MEMORIAL MARKERS AND METHOD FOR PRODUCING THE SAME

BACKGROUND OF THE INVENTION

1. Field of the Invention

The present invention relates to a new type of memorial marker for use at a gravesite in a cemetery to provide information on the deceased person that is buried there and to mark the gravesite.

2. Description of the Related Art

Currently available memorial markers are generally of two basic types, i.e. a marker created entirely of granite, marble or concrete, or alternately, a marker created from cast metal, such as bronze, that is created by a casting process such as traditional sand casting. Manufacture of both of these types of markers is labor intensive and thus both are very expensive to make and both must be sold to the consumer for a high price. Also, both types of markers must be produced at a remote manufacturing facility and transported to the gravesite. This adds to the cost of the markers and to the time delay in getting a marker set at a gravesite. Also, both types of markers are difficult or impossible to repair when they are damaged, such as when the marker is struck by a lawn mower or run over by a vehicle. Often when this type of damage occurs, the entire marker must be removed from the gravesite and replaced. This makes these types of markers expensive to maintain. Since the damage to the marker may occur many years after the marker was initially installed, often the family of the deceased person for whom the marker was purchased will not have the money to replace the marker and the damaged marker will remain at the gravesite.

The present invention addresses these shortcomings by providing a new type of marker that is esthetically pleasing and is durable. This new marker looks similar to cast bronze memorial markers and can withstand the elements as well or better than currently available memorial markers. Also, the present invention is constructed with less expensive materials and by a method that is less labor intensive, making the memorial markers easier and cheaper to make, thus greatly reducing the cost of the marker to the consumer. The present invention is also assembled with modular elements that can be added to the marker by the local funeral home, making it possible to reduce the delay in having a marker installed at the gravesite and making repairs to the marker cheaper and easier. Finally, the memorial marker of the present invention offers features not presently available in currently available markers, such as a sealed and locked compartment in the marker for including mementos or information relating to the deceased person and a remote locating device for allowing family members to use a hand-held device to assist in locating a specific memorial marker in a cemetery.

SUMMARY OF THE INVENTION

The present invention is a new type of memorial marker for use in marking the gravesite of a deceased person and the method for producing the marker. The memorial marker is created from a top sheet of bronze and a mating bottom sheet of bronze that are each formed individually into the desired shape for the marker. The sheets of bronze may be formed by a sheet metal pressing process, by pressing the sheets between positive and negative dies, by negative bladder pressing, i.e. pressing the sheets between a negative die and a bladder, by explosive forming, or by any other suitable sheet metal forming process. In the forming process, the top sheet is normally formed so that the top surface is leather looking or smooth. The top sheet may also be formed so that it contains a lower base portion at its perimeter, contains an opening for a vase, contains downwardly facing, threaded bolt receiving slugs, and contains internal elements such as bolt receiving slugs or resealable compartments for holding memorabilia or remote locating devices. Screw receiving holes for receiving screws that will secure external elements to the top surface of the marker may be formed into the top sheet when the sheet undergoes sheet metal forming, or alternately, may be created in the top sheet after the top sheet is formed.

The bottom sheet is formed into a configuration so that it is provided with an upwardly extending lip at its perimeter and the top sheet is also formed into a configuration so that it is provided with a downwardly extending lip at its perimeter. The bottom sheet is slightly smaller that the top sheet so that the upwardly extending lip of the bottom sheet is capable of being received within the downwardly extending lip of the top sheet to form a void between the top and bottom sheets.

Once the top and bottom sheets are formed into the desired configuration, the bottom sheet is filled with a castable filler material that will harden. The top sheet is then lowered over the bottom sheet so that the castable filler material fills the void created between the top and bottom sheets. The top and bottom sheets are then secured together at the edge of the downward extending lip of the top sheet, via welding or other suitable means.

At this point, various external elements that will be secured to the top surface of the top sheet are created. These external elements may include the family name of the deceased person, the first and middle name or initial of the deceased person, the dates of birth and death for the deceased person, decorative edging for the marker, locking lids for any internal resealable compartments that were added to the marker when the top and bottom sheets were formed, and flower vase sleeves and vases. Each of these external elements may be formed from additional sheets of bronze by a sheet metal forming process, or alternately, if the family prefers, may be made from cast bronze. External elements of cast bronze will be more expensive and will require longer to create since they must be produced by the same labor intensive methods currently employed to create cast bronze memorial markers.

Screw holes will be made in the external elements as need to secure the external elements to the predrilled screw receiving holes that were previously formed in the top sheet of the marker. The screw holes may be created in the external elements when they are formed, may be created in the external elements after the elements are formed, or may be created in the external elements during the casting process for those elements that are made from cast bronze.

Once the external elements have been created, they are secured to the top sheet of the memorial marker via screws that insert through the screw holes in the external elements and engage the screw receiving holes in the top sheet of the memorial marker.

The memorial marker is then secured to a base. The base will normally be a slab of granite, marble or pre-formed concrete. The slab of granite, marble or concrete is predrilled so that it contains bolt openings extending through the slab from bottom to top and the bolt openings are aligned with the threaded bolt receiving slugs. In order to secure the marker to the slab, bolts are first inserted through large washers, then through the slab from the bottom side, and then are threaded into the threaded bolt-receiving slugs. The bolts are then turned until the marker is firmly secured to the slab.

Once the marker is secured to the slab, the slab and marker are ready to be installed at the gravesite. If the slab is of granite or marble, cement is generally added to a hole underneath where the slab is to be placed in order that the slab will be sufficiently supported. If the slab is of concrete, the addition of a cement pad underneath the slab is not necessary and the concrete slab can be placed directly on the ground at the desired location.

DETAILED DESCRIPTION OF THE PREFERRED EMBODIMENT

The Invention

Figure 1:
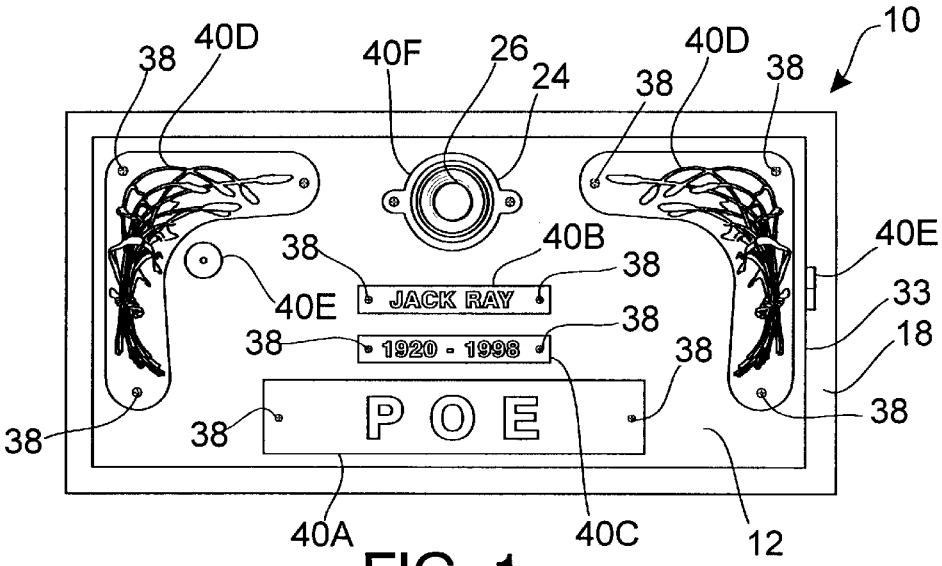
FIG. 1 is a top plan of a memorial marker constructed in accordance with a preferred embodiment of the present invention.
Figure 2:
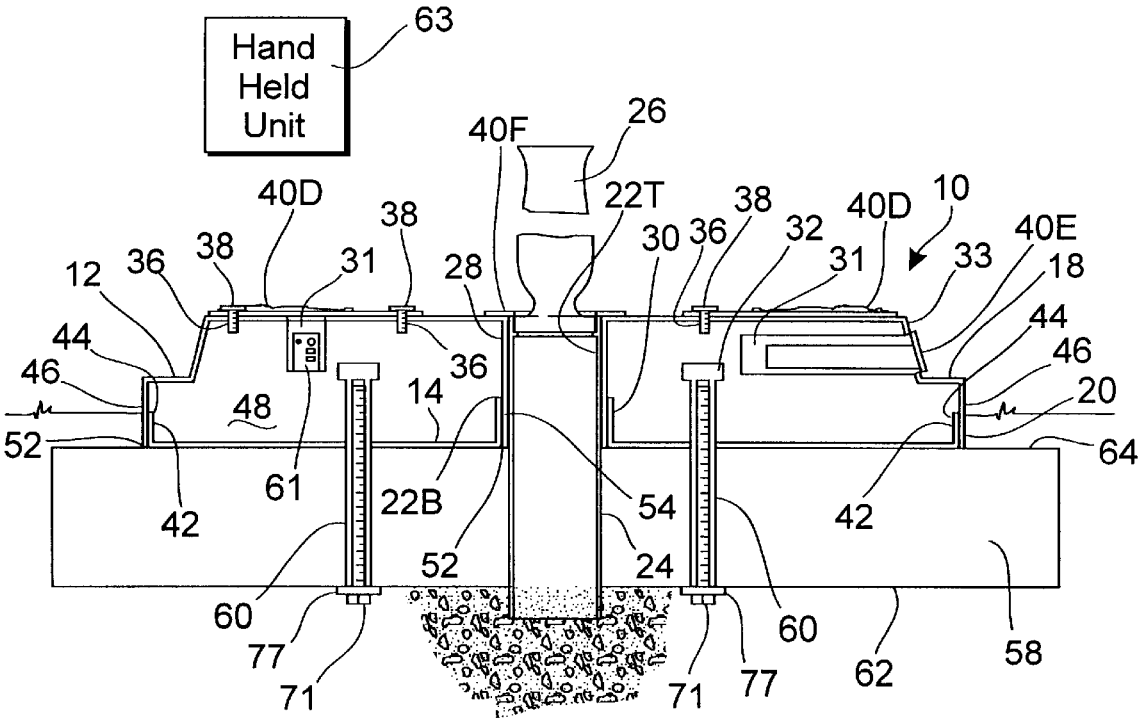
FIG. 2 is a front side view of the memorial marker of FIG. 1, showing internal elements in outline and showing a hand held unit for communicating with a transponder within a resealable compartment of the marker.

Referring now to FIGS. 1 and 2, there is illustrated a memorial marker 10 for use in marking the gravesite of a deceased person that is constructed in accordance with a preferred embodiment of the present invention. The memorial marker 10 is constructed of a bronze top sheet 12 that has been formed by a sheet metal forming process such as by pressing it between a positive mold and a mating negative mold in a large sheet metal press (not illustrated) from a flat sheet of bronze and of a bronze bottom sheet 14 that has also been formed in a similar manner from another flat sheet of bronze. The top sheet 12 and its mating bottom sheet 14 are each formed individually into the desired shape for the marker 10. Although the marker 10 can be formed into a variety of shapes, a rectangular shape is generally preferred by consumers, as illustrated in the rectangular shaped marker 10 that is illustrated in FIGS. 1 and 2.

Figure 14:
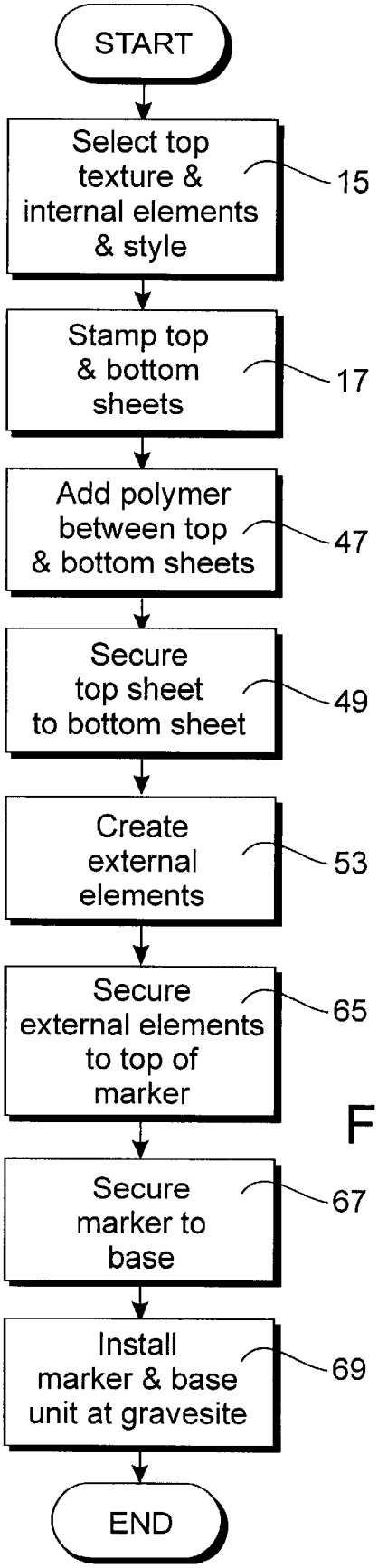
FIG. 14 is a flow chart of the process for making a memorial marker in accordance with the present invention.

FIG. 14 is a diagram of the process for making a marker 10, or an alternate embodiment marker 10'. Box 15 in FIG. 14 shows the first step in making a marker 10 or 10' is selecting the texture for the top surface 16; selecting the internal elements, such as resealable compartments 31 and bolt receiving slugs 32, to be included in the marker 10 or 10'; and selecting the style, i.e. whether the top sheet 12 be will be made with a lower base portion 18 as marker 10 or whether the top sheet 12' be will be made without a lower base portion 18 as marker 10'. The second step in the process, as illustrated in FIG. 14 by box 17, is to form the top sheet 12 or 12' and the bottom sheet 14 by a sheet metal forming process such as, for example, pressing or stamping.

In the forming process, the top sheet 12 is normally formed so that the top surface 16 either is an embossed leather-looking surface or is smooth. The top sheet 12 may also be formed so that it contains a lower base portion 18 at its perimeter 20, as illustrated by the marker 10 that is illustrated in FIGS. 1 and 2. Alternately, an alternate embodiment top sheet 12' may be formed so that it does not contain a lower base portion 18 at its perimeter 20, as illustrated in alternate embodiment marker 10', illustrated in FIGS. 3 and 4.

Figure 6:
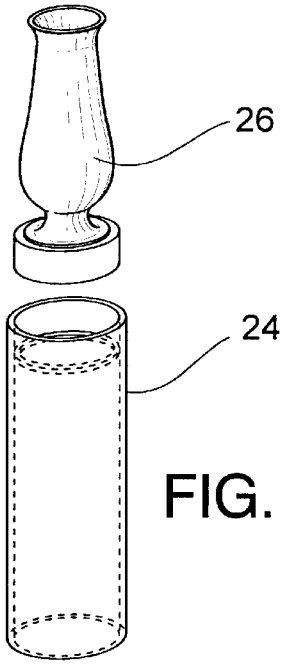
FIG. 6 is a perspective view of a vase and a vase-receiving sleeve, as they appear removed from the marker.
Figure 7:
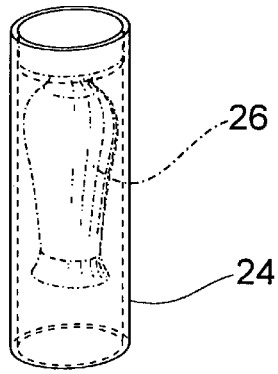
FIG. 7 is perspective view of the vase and vase-receiving sleeve of FIG. 6, showing the vase inverted in its storage position within the vase-receiving sleeve.

When the top sheet 12 or 12' is are formed, the sheet 12 or 12' may be formed so that it contains a vase opening 22T for admitting a vase sleeve 24 and a vase 26. The vase sleeve 24 and vase 26 are illustrated in FIG. 6 in the in use position, and the sleeve 24 and vase 26 are illustrated in FIG. 7 in the stored position. Likewise, when the bottom sheet 14 is formed, the sheet 14 may be formed so that it contains a vase opening 22B for admitting the vase sleeve 24 and the vase 26. The top sheet 12 or 12' is provided with a downwardly extending vase lip 28 surrounding the vase opening 22T, and the bottom sheet 14 is provided with an upwardly extending vase lip 30 surrounding the vase opening 22B. The upwardly extending vase lip 30 surrounds the downwardly extending vase lip 28 when the top sheet 12 or 12' is secured to the bottom sheet 14.

Figure 3:
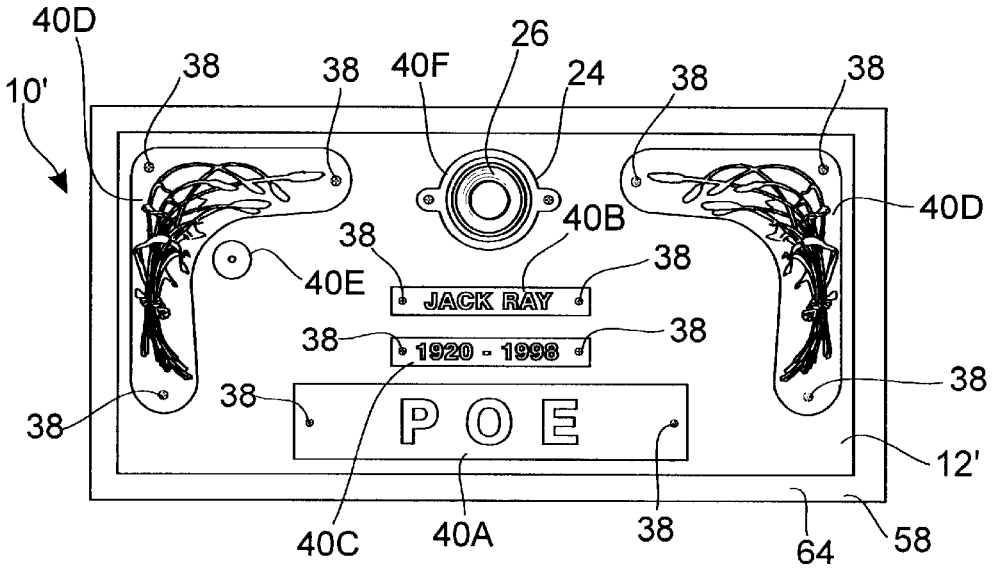
FIG. 3 is a top plan of an alternate embodiment memorial marker.

When the top sheet 12 or 12' is formed, it may also contain internal elements such as resealable compartments 31 and bolt receiving slugs 32. The resealable compartments may be provided opening to the top surface 16 of the top sheet 12, as illustrated in FIGS. 1 and 3, or alternately, may be provided opening to the side 33 of the memorial marker 10, as illustrated in FIG. 3. When the bottom sheet 14 is formed, it will contain downwardly facing, threaded bolt receiving slugs 32 that will be used in securing the marker 10 or 10' to a base 58.

Screw receiving holes 36 for receiving screws 38 that will secure external elements 40A, 40B, 40C, 40D, 40E, 40F etc. to the top surface 16 of the marker 10 or 10' may be formed into the top sheet 12 or 12' when the top sheet 12 or 12' is formed, or alternately, may be created in the top sheet 12 or 12' after the top sheet 12 or 12' is formed.

The bottom sheet 14 is formed into a configuration so that it is provided with an upwardly extending lip 42 at its perimeter 44. The top sheet 12 or 12' is also formed into a configuration so that it is provided with a downwardly extending lip 46 at its perimeter 20. The bottom sheet 14 is slightly smaller that the top sheet 12 or 12' so that the upwardly extending lip 42 of the bottom sheet 14 is capable of being received within the downwardly extending lip 46 of the top sheet 12 or 12', thus forming a void space between the bottom sheet 14 and the top sheet 12 or 12'.

As shown in box 47 in FIG. 14, the third step in the process is adding castable filler material between the top and bottom sheets 12 or 12' and 14. Once the top sheet 12 or 12' and the bottom sheet 14 are formed into the desired configurations, the bottom sheet 14 is filled with a castable filler material 48, such as a polymer, that will harden. Although a variety of castable filler material 48 may be employed for this purpose, polyurethane that has been mixed with marble dust has been found to work well.

The top sheet 12 or 12' is then lowered over the bottom sheet 14 so that the castable filler material 48 fills the void created between the top and bottom sheets 12 or 12' and 14. As illustrated by box 49 in FIG. 14, the fourth step in the process is securing the top sheet 12 or 12' to the bottom sheet 14. The top and bottom sheets 12 or 12' and 14 are secured together at the perimeter 20 of the downward extending lip 46 of the top sheet 12 or 12', via welds 52 or other suitable securing means. If vase openings 22T and 22B were provided in the top and bottom sheets 12 or 12' and 14, it will also be necessary to secured the top and bottom sheets 12 or 12' and 14 together at the edge 54 of the downwardly extending vase lip 28 of the top sheet 12 or 12' via welds 52 or other suitable securing means.

As illustrated by box 53 in FIG. 14, the fifth step in the process is creating the external elements 40A, 40B, 40C, 40D, 40E, 40F, etc that will be attached to the top sheet 12 or 12'. At this point, various external elements 40A, 40B, 40C, 40D, 40E, 40F, etc. that will be secured to the top surface 16 of the top sheet 12 or 12' are created. These external elements 40A, 40B, 40C, 40D, 40E, 40F, etc. may include an external element 40A that bears the family name of the deceased person, an external element 40B that bears the first name, middle name or initial, or a nickname for the deceased person, an external element 40C that bears the dates of birth and death for the deceased person, an external element 40D that bears a decorative edging for the marker, an external element 40E that is a locking lid for an internal resealable compartment that was added to the marker 10 or 10' when the top and bottom sheets 12 or 12' and 14 were formed, and an external element 40F that is the flower vase sleeve 24 with its associated flower vase 26.

Figure 4:
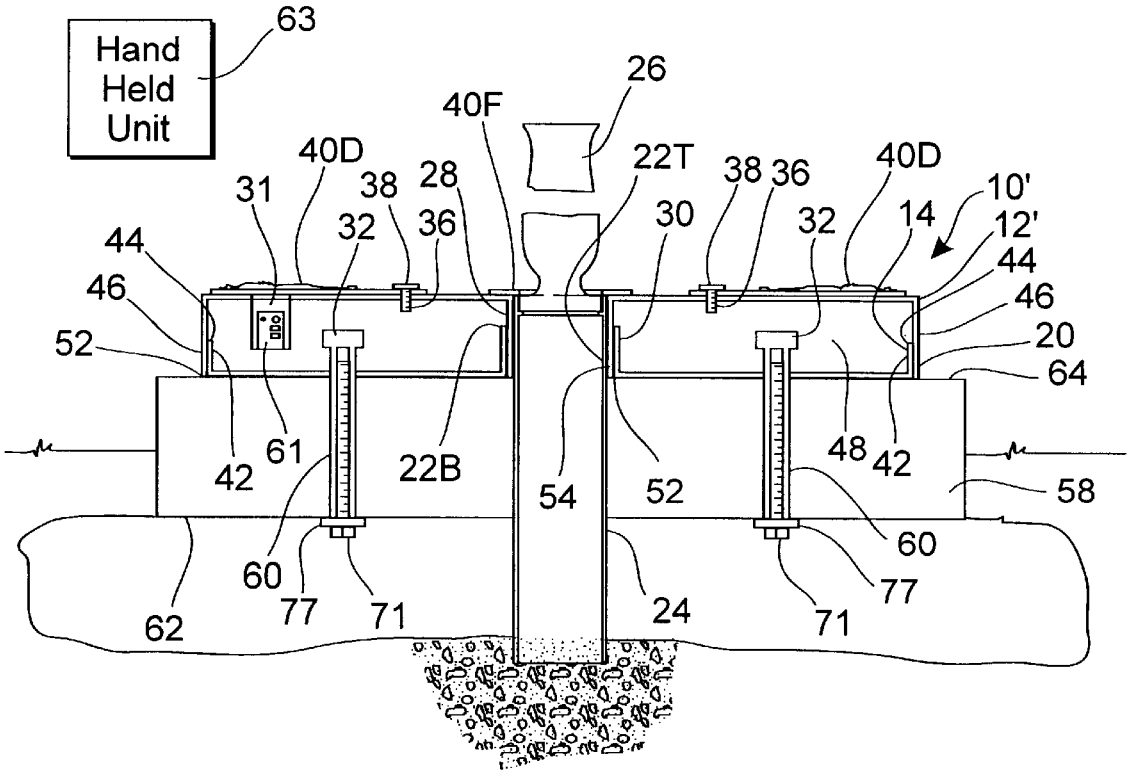
FIG. 4 is a front side view of the alternate embodiment memorial marker of FIG. 3, showing internal elements in outline and showing a hand held unit for communicating with a transponder within a resealable compartment of the marker.

As illustrated in FIGS. 2 and 4, it is desirable for the flower vase sleeve 24 to extend through both the marker 10 or 10' and a base 58 on which the marker 10 or 10' secures so that water can drain out of the flower vase sleeve 24 into the surrounding gravel via openings that are provided in the bottom of the sleeve 24. When the base 58 and attached marker 10 or 10' and sleeve 24 are installed at a gravesite, it is desirable to place a layer of gravel under the base 58 to allow for proper drainage of the sleeve 24.

Figure 8:
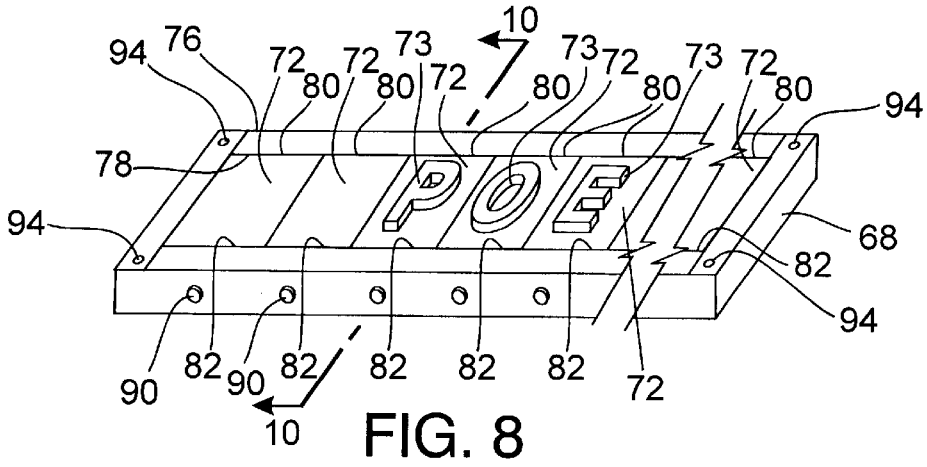
FIG. 8 is perspective view of a positive die frame with die blocks that contain raised alphanumeric symbols removably inserted therein to form the family name of a deceased person within the die frame.
Figure 9:
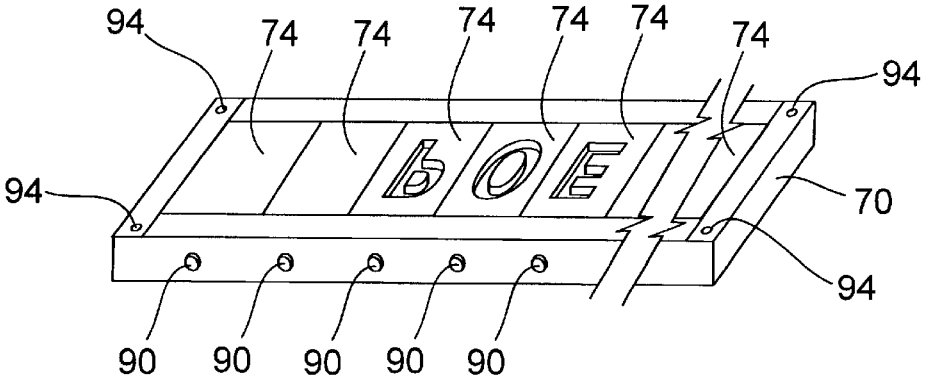
FIG. 9 is a perspective view of a negative die frame with die blocks that contains recessed alphanumeric symbols removably inserted therein to mate with the positive die frame of FIG. 8.
Figure 10:
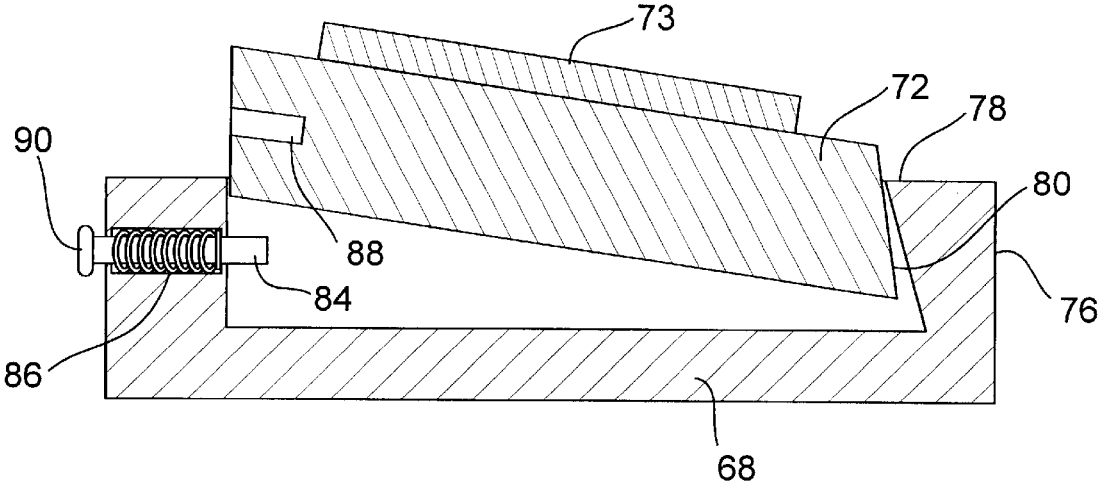
FIG. 10 is an enlarged cross sectional view of a die block and positive die frame of FIG. 8 taken along line 10—10, showing how the die blocks are removably secured to the die frame.
Figure 11:
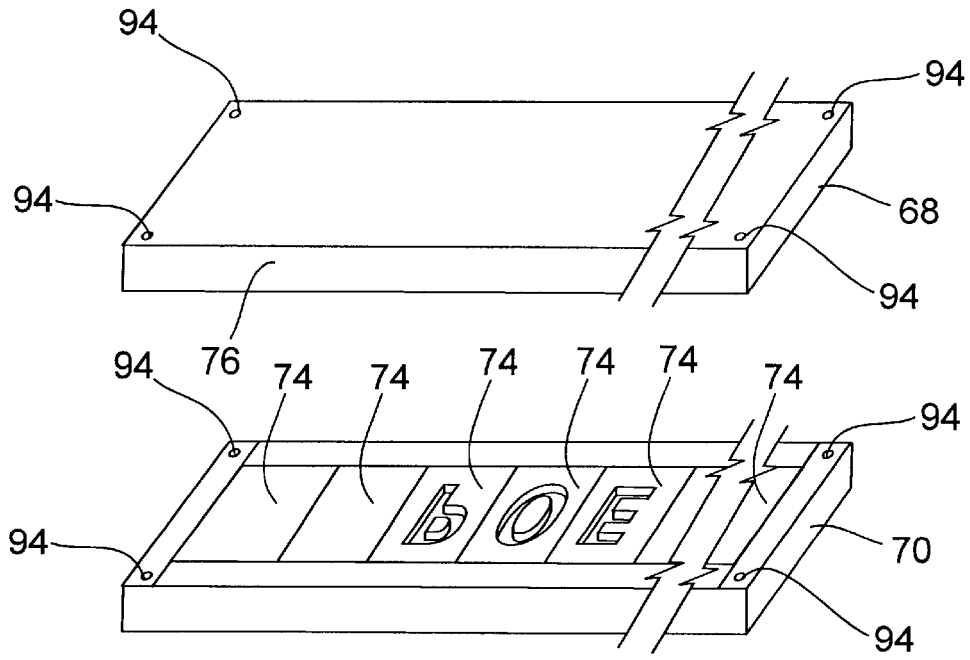
FIG. 11 is a perspective view of the positive die frame of FIG. 8 inverted over its negative die frame of FIG. 9.

FIGS. 8, 9 and 10 illustrate the method for making a variety of external elements 40A, 40B, 40C, 40D, 40E, 40F, etc. by a sheet metal forming process such as pressing sheets of bronze 66 between a positive die frame 68 and a mating negative die frame 70. The positive die frame 68 is provided with interchangeable die blocks 72 that contain raised alphanumeric symbols 73 removably inserted therein to form words or dates. Likewise, the negative die frame 70 is provided with interchangeable die blocks 74 that contain recessed alphanumeric symbols 75 removably inserted therein to mate with the positive die frame 68 when they are placed face to face, as shown in FIG. 11.

FIG. 10 illustrates how each of the die blocks 72 removably inserts into the positive die frame 68. One side 76 of the positive die frame 68 is provided with an angled protruding upper ledge 78 under which one end 80 of each of the die blocks 72 inserts. An opposite second end 82 of each of the die blocks 72 inserts into an opposite side 84 of the positive die frame 68. The opposite side 84 of the positive die frame 68 is provided with a retaining pin 84 in association with each of the die blocks 72. Each of the retaining pins 84 is inwardly biased by means of a spring 86 or other suitable biasing mechanism. Each die block 72 is provided on its second end 82 with a pin receiving opening 88 for removably receiving its associated retaining pin 84. The retaining pin 84 removably secures its associated die block 72 within the die frame 68.

In order to remove the die block 72 from the die frame 68, a head 90 of the retaining pin 84 that is provided on the outside of the die frame 68 is pulled outward. This causes the retaining pin 84 to be removed from the pin receiving opening 88. The die block 72 then can be lifted out of the die frame 68.

To insert another die block 72 into the frame 68, the head 90 of the retaining pin 84 is again pulled outward, and another die block 72 is inserted into the die frame 68. The head 90 is then released and the inwardly biased retaining pin 84 inserts into the pin receiving opening 88 provided in the second end 82 of the die block 72.

Although not illustrated, the die blocks 74 that insert into the negative die frame 70 are removeably secured therein by a similar arrangement of protruding upper ledge 78, inwardly biased retaining pins 84 with heads 90, and pin receiving openings 88 as those described for the positive die frame 68 and die blocks 70.

Figure 12:
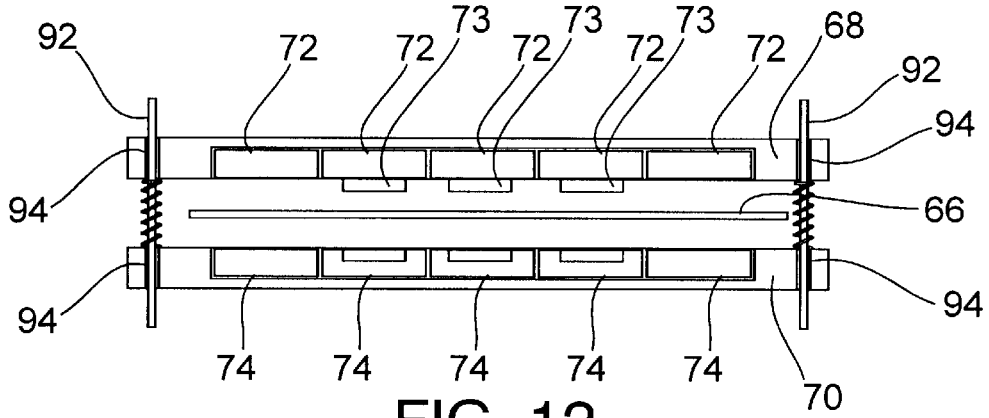
FIG. 12 is a side view of the frames of FIG. 11 shown with a bronze sheet between the frames and shown with spring loaded alignment pins inserted through alignment holes provided in the frames.
Figure 13:
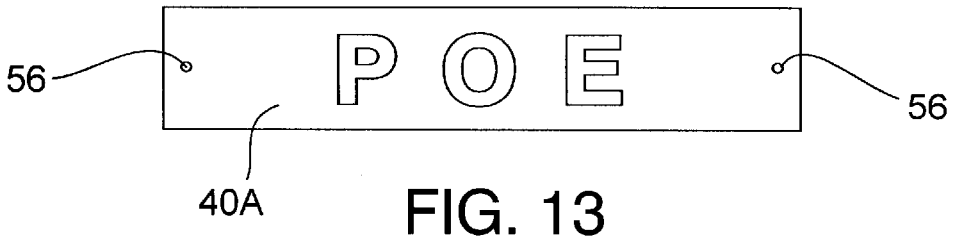
FIG. 13 is a top plan view of the bronze sheet of FIG. 12, as it would appear after being pressed between the frames of FIG. 12.

FIG. 11 illustrates how the positive and negative die frames 68 and 70 fit together face to face by inverting the positive die frame 68 over the negative die frame 70. FIG. 12 shows the positive and negative die frames 68 and 70 properly aligned by means of spring loaded alignment pins 92 that insert through alignment holes 94 provided in the frames 68 and 70. A sheet of bronze 66 is inserted between the two frames 68 and 70 and then the entire assembly is inserted into a sheet metal press and pressed in order to form the sheet of bronze 66 into the external element 40A that bears the family name of the deceased person, as illustrated in FIG. 13.

The alignment pins 92 are spring biased so that the two die frames 68 and 70 are pushed apart from each other and from the external element 40A that has been created when the sheet of bronze 66 was pressed between the die frames 68 and 70. By having the alignment pins 94 spring biased in this manner, it is easier to remove the external element 40A from the die frames 68 and 70 when they are removed from the sheet metal press. It may be desirable to add castable filler material 48 to the inverted external elements 40A, 40B, 40C, and 40D in order to strengthen them.

Figure 5:
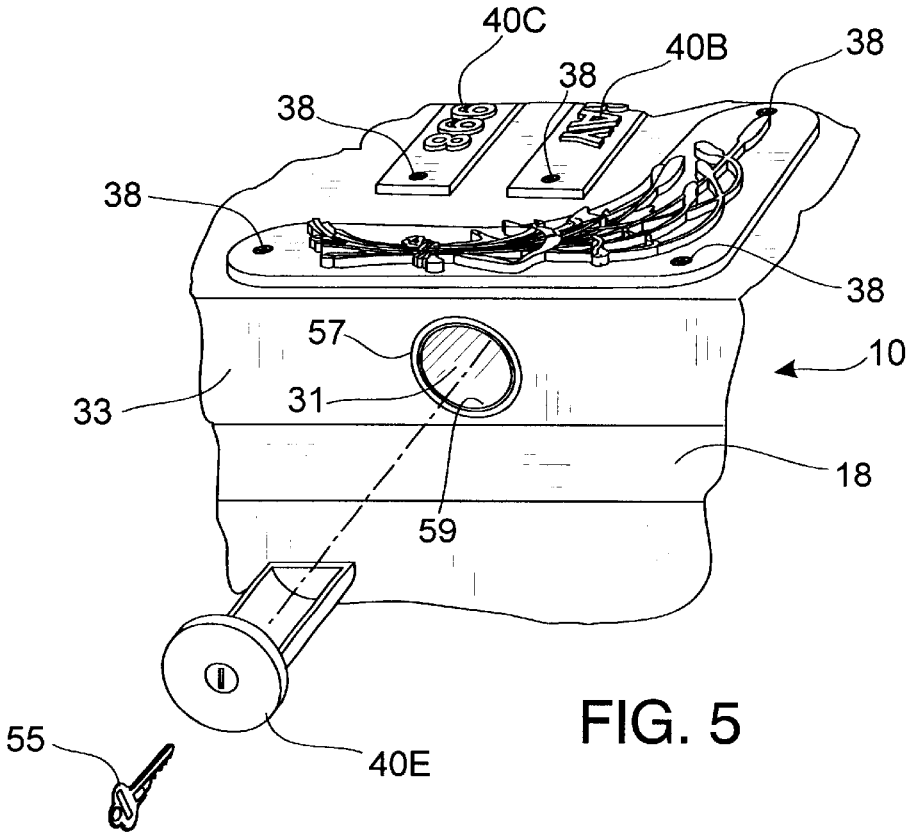
FIG. 5 is an enlarged perspective view of the opening to an internal resealable compartment in the memorial marker of FIG. 1, showing details of how the lid locks to seal the resealable compartment.

The type and number of external elements 40A, 40B, 40C, 40D, 40E, 40F, etc. that are produced will be determined by the type of marker 10 or 10' to be created. As illustrated in FIG. 5, the locking lid 40E is provided with locking means 55, such as for example a key lock and key, or alternately, a special type of star head screw and screw driver, to removably secure the locking lid 40E to the resealable compartment 31.

To insure that the resealable compartment 31 remains dry inside, an o-ring 57 is provided at the mouth 59 of the resealable compartment 31 so that the o-ring 57 is captured between the mouth 59 of the resealable compartment 31 and the locking lid 40E when the lid 40E is attached to the resealable compartment 31. Also, the lid 40E may optionally be provided with a tray or trough attached thereto so objects may be more easily inserted into and removed from the resealable compartment 31.

These resealable compartments 31 allow a small transponder 61 to be placed in the resealable compartment 31. By having a transponder 61 safely stored in the resealable compartment 31, a person can use a hand held device 63 to elicit a signal from the transponder 61 that allows the person to easily locate the marker 10 or 10'. This is a particularly attractive feature for markers 10 or 10' that are located in large cemeteries where it is often difficult for friends and family members to locate a grave site of a friend or loved one. Although the invention has been described as having resealable compartments 31, the invention is not so limited and the compartments may be permanently sealed. However, resealable compartments 31 are preferred since they can be opened to access the transponder and remove items from the resealable compartment 31.

Each of these external elements 40A, 40B, 40C, 40D, 40E, 40F, etc. may be formed from additional sheets of bronze, or alternately, if the family of the deceased person prefers, may be made from cast bronze. External elements 40A, 40B, 40C, 40D, 40E, 40F, etc. formed from cast bronze will be more expensive and will require longer to create since they must be produced by the same labor intensive methods currently employed to create currently available cast bronze memorial markers.

As shown by box 65 in FIG. 14, the sixth step in the process is securing the external elements to the top sheet 12 or 12' of the marker 10 or 10'. Screw holes 56 will be made in the external elements 40A, 40B, 40C, 40D, 40E, 40F, etc. as need to secure the external elements 40A, 40B, 40C, 40D, 40E, 40F, etc. to the predrilled screw receiving holes 36 that were previously formed in the top sheet 12 or 12' of the marker 10 or 10'. The screw holes 56 may be created into the external elements 40A, 40B, 40C, 40D, 40E, 40F, etc. when they are formed, may be created in the external elements 40A, 40B, 40C, 40D, 40E, 40F, etc. after the elements 40A, 40B, 40C, 40D, 40E, 40F, etc. are formed, or may be formed in the external elements 40A, 40B, 40C, 40D, 40E, 40F, etc. during the casting process for those elements 40A, 40B, 40C, 40D, 40E, 40F, etc. that are made from cast bronze.

Once the external elements 40A, 40B, 40C, 40D, 40E, 40F, etc. have been created, they are secured to the top sheet 12 or 12' of the memorial marker 10 or 10' via screws 38 that insert through the screw holes 56 provided in the external elements 40A, 40B, 40C, 40D, 40E, 40F, etc. and engage the screw receiving holes 36 provided in the top sheet 12 or 12' of the memorial marker 10 or 10'.

As illustrated by box 67 in FIG. 14, the seventh step in the process is securing the marker 10 or 10' to the base 58. The base 58 will normally be a slab of granite, marble or pre-formed concrete. The base 58 is predrilled so that it contains bolt openings 60 extending through the base 58 from bottom 62 to top 64 of the base 58 and the bolt openings 60 are aligned with their associated threaded bolt receiving slugs 32 previously provided in the bottom sheet 14 of the memorial marker 10 or 10'. In order to secure the marker 10 or 10' to the base 58, bolts 71 are first inserted through large washers 77, then inserted through the bolt openings 60 in the base 58 from bottom 62 to top 64, and finally are threaded into the threaded bolt-receiving slugs 32. The bolts 71 are then rotated until the marker 10 or 10' is firmly secured to the base 58.

As illustrated by box 69 in FIG. 14, the eighth and final step in the process is installing the marker 10 or 10' and the base 58 at the gravesite. Once the marker 10 or 10' is secured to the base 58, the base 58 and marker 10 or 10' are ready to be installed at the gravesite. If the base 58 is a slab of granite or marble, cement is generally added to a hole underneath where the base 58 is to be placed in order that the base 58 will be sufficiently supported. If the base 58 is a slab of concrete, the addition of a cement pad underneath the base 58 is not necessary and the concrete base 58 can be placed directly on the ground at the desired location.

Although the memorial marker 10 or 10' has been described as having a bottom sheet 14, it is possible to make the invention without a bottom sheet 14. In that case, the castable filler material 48 is simply added to the inverted top sheet 12 after the top sheet 12 has been formed.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A memorial marker for marking a gravesite comprising:

a top sheet of bronze that has been formed by a sheet metal forming process to form a top half of a memorial marker, a bottom sheet of bronze that has been formed by a sheet metal forming process to form a bottom half of the memorial marker, said top sheet and said bottom sheet together form the memorial marker with a void space therebetween, castable filler material filling said void space between the top half and bottom half of the memorial marker, and said top half secured to said bottom half of the memorial marker so that the castable filler material is enclosed within the two halves: and replaceable external elements removably secured to said top half of said memorial marker.

2. A memorial marker according to claim 1 further comprising:

said memorial marker secured to a base.

3. A memorial marker according to claim 1 further comprising:

screws insertably through screw holes provided in said external elements and engagable with screw receiving holes provided in said top half of said memorial marker as a means for removably securing said external elements to said top half of said memorial marker.

4. A memorial marker according to claim 1 wherein said external elements are created by forming sheets of bronze into the desired configurations.

5. A memorial marker according to claim 4 wherein said external elements are created by forming sheets of bronze between positive and negative die frames.

6. A memorial marker according to claim 5 wherein the positive die frame removably secures therein die blocks having raised alphanumeric symbols, and the negative die frame removably secures therein die blocks having recessed alphanumeric symbols so that the raised and recessed alphanumeric symbols mate together when the two die frames are placed together.

7. A memorial marker according to claim 1 wherein the external elements comprise:

at least one name plaque.

8. A memorial marker according to claim 1 wherein the external elements comprise:

at least one date plaque.

9. A memorial marker according to claim 1 wherein the external elements comprise:

at least one decorative plaque.

10. A memorial marker according to claim 1 wherein the external elements comprise:

at least one vase sleeve with associated removable vase.

11. A memorial marker according to claim 1 further comprising:

internal elements provided between said top half and said bottom half of said memorial marker.

12. A memorial marker according to claim 11 wherein said internal elements comprise:

at least one compartment.

13. A memorial marker according to claim 12 further comprising:

a transponder located within at least one compartment in the memorial marker, and a hand held device for activating said transponder in order to locate the memorial marker in a cemetery.

14. A memorial marker according to claim 12 wherein said compartments are resealable.

15. A memorial marker according to claim 11 wherein said internal elements comprise:

at least one bolt receiving slug for receiving a bolt in order to secure said memorial marker to said base.

16. A memorial marker according to claim 1 wherein said top half of said memorial marker is provided with a lower base portion at a perimeter of the top half.

17. A memorial marker according to claim 1 wherein said top sheet includes a downwardly extending lip and said bottom sheet includes an upwardly extending lip which mate together.

* * * * *